US006367383B1

(12) United States Patent
Leenders et al.

(10) Patent No.: US 6,367,383 B1
(45) Date of Patent: Apr. 9, 2002

(54) IMAGING ELEMENT FOR DIFFERENT IMAGING SYSTEMS

(75) Inventors: Luc Leenders, Herentals; Joan Vermeersch, Deinze, both of (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/587,260

(22) Filed: Jun. 5, 2000

Related U.S. Application Data

(60) Provisional application No. 60/140,979, filed on Jun. 29, 1999.

(30) Foreign Application Priority Data

Jun. 21, 1999 (EP) ..... 99201990

(51) Int. Cl.[7] ..... B41C 1/10
(52) U.S. Cl. ..... 101/465; 101/462
(58) Field of Search ..... 101/457, 462, 101/463.1, 465, 466, 467

(56) References Cited

U.S. PATENT DOCUMENTS 3,558,881 A 1/1971 Gold ..... 430/348
4,004,924 A * 1/1977 Vrancken et al. ..... 101/470
4,833,486 A * 5/1989 Zerillo ..... 101/467
5,501,150 A * 3/1996 Leenders et al. ..... 101/466
5,621,449 A * 4/1997 Leenders et al. ..... 347/101
5,738,013 A * 4/1998 Kellett ..... 101/463.1
5,750,314 A * 5/1998 Fromson et al. ..... 430/302
5,820,932 A * 10/1998 Hallman et al. ..... 101/466
6,019,045 A * 2/2000 Kato et al. ..... 101/466
6,025,100 A * 2/2000 Verschueren et al. ..... 430/49
6,033,740 A * 3/2000 Oelbrandt et al. ..... 101/465
6,131,514 A * 10/2000 Simons ..... 101/466
6,196,129 B1 * 3/2001 Kellett ..... 101/465

* cited by examiner

*Primary Examiner*—Stephen R. Funk
(74) *Attorney, Agent, or Firm*—Breiner & Breiner, L.L.C.

(57) ABSTRACT

According to the present invention there is provided a method for preparing a lithographic printing plate, comprising the step of dispensing in a predetermined pattern a hydrophobic or hydrophobizing composition onto a receiving element comprising on a support a layer comprising hydrophobic thermoplastic polymer particles dispersed in a hardened hydrophilic binder.

8 Claims, No Drawings

IMAGING ELEMENT FOR DIFFERENT IMAGING SYSTEMS

This application claims the benefit of U.S. Provisional Application No. 60/140,979 filed Jun. 29, 1999.

FIELD OF THE INVENTION

The present invention relates to a solution for the use of the same receiving element in combination with different writing heads.

More specifically the invention is related to a receiving element that can be imaged with heat and with ink jet.

BACKGROUND OF THE INVENTION

In computer to plate lithography, there exist different recording techniques for imaging a printing plate such as a laser, a thermal head, an ink jet printing head, etc. . . .

The imaged printing plates can then be used as printing elements without any processing step or alternatively after some kind of processing. Such printing elements can allow recording on press.

It is a very desirable property of the printing press that it can be used with an imaging element that can be imaged with different writing heads; those different heads can all be present on the press and can be used for recording separately or in any combination.

EP-A-770 497 discloses a method for making a lithographic printing plate comprising the steps of: (1) image-wise exposing to light an imaging element comprising (i) on a hydrophilic surface of a lithographic base an image forming layer comprising hydrophobic thermoplastic polymer particles dispersed in a hydrophilic binder and (ii) a compound capable of converting light to heat, said compound being comprised in said image forming layer or a layer adjacent thereto; (2) and developing a thus obtained image-wise exposed imaging element by rinsing it with plain water or an aqueous liquid.

A method wherein an image or non-image portion is directly formed on a substrate by ink-jet printing is known to the art. The ink-jet printing system is a relatively rapid image output system and has a simple construction because it does not require any complex optical system. Therefore, the printing system makes an apparatus for making printing plates simple and the cost for making printing plates can be reduced since the maintenance labor is largely reduced.

As examples of the methods for preparing printing plates by using the ink-jet printing system, Japanese Kokai Publication 113456/1981 proposes the methods for preparing printing plates wherein ink-repelling materials (e.g. curable silicone) are printed on a printing plate by ink-jet printing. The printing plate obtained by this method is an intaglio printing plate in which the ink-repelling material formed on the surface of the substrate serves as a non-image part. As a result, the resolution of the printed images at shadow area or reversed lines is not so good. Moreover, a large amount of ink is needed in this method because the ink-repelling material must be deposited on the whole non-image part which occupies most of the surface of the printing plate, thereby delaying the printing process.

U.S. Pat. No. 5,511,477 discloses a method for the production of photopolymeric relief-type printing plates comprising: forming a positive or a negative image on a substrate by ink-jet printing with a photopolymeric composition, optionally preheated to a temperature of about 30°–260° C., and subjecting the resulting printed substrate to UV radiation, thereby curing said composition forming said image.

The receiving layer is not specified.

U.S. Pat. No. 5,312,654 discloses a method for making lithographic printing plates comprising: forming an image on a substrate having an ink absorbing layer and a hydrophilized layer between the substrate and absorbing layer by ink-jet printing using a photopolymerizable ink composition, and exposing it to an active light in the wavelength region for which said ink composition is sensitized to cure the image. The printing endurance of said printing plates is low.

Japanese Kokai Publication 69244/1992 discloses a method for making printing plates comprising the steps of forming a printed image on a recording material subjected to a hydrophilic treatment by ink-jet printing using a hydrophobic composition containing photocurable components; and exposing the whole surface to an active light. However, the surface of the substrate to be used for the lithographic plate is usually subjected to various treatments such as a mechanical graining, an anodizing or a hydrophilic treatment to obtain good hydrophilic property and water retention property. Therefore, even the use of an ink composition having a very high surface tension results in a poor image on the surface of the substrate because of ink spreading and low printing endurance.

EP-A-533 168 discloses a method for avoiding said ink spreading by coating the lithographic base with an ink absorbing layer which is removed after ink printing. This is an uneconomical and cumbersome method.

Research Disclosure 289118 of May 1988 discloses a method for making printing plates with the use of an ink jet wherein the ink is a hydrophobic polymer latex. However said printing plates have a bad ink acceptance and a low printing endurance.

EP-A-003 789 discloses a process for the preparation of offset printing plates by means of an ink jet method with oleophilic compositions. There is not indicated how said compositions are made but from the examples it is clear that it concerns artificial lattices, which are difficult to prepare. The receiving layer is not specified.

JN-57/038142 discloses a method of preparing a printing plate by forming an ink image on a blank printing plate, and also by fixing this image thermally by making toner adhere to this image-formed area. The composition of the ink is not mentioned, only the composition of the toners is disclosed.

JN-07/108667 discloses a plate-making method forming an ink image containing a hydrophilic substance on a conductive support whose surface layer is made hydrophilic according to an electrostatic attraction type ink set system to dry or cure the same, by applying bias voltage to the conductive support at the time of ink jet writing. This is a cumbersome process.

U.S. Pat. No. 5,213,041 discloses a method for preparing a re-usable printing plate for printing, projecting an imaging deposit on the plate surface by jet printing using an ejectable substance containing a heat fusible component. The image forms an imaging deposit, which is fused to the surface of the printing plate using a variable frequency and variable power induction heater. This is a cumbersome method.

OBJECTS OF THE INVENTION

It is an object of the present invention to provide a method for preparing a printing plate by ink jet, using a receiving element that is also usable as imaging element in direct thermal or heat mode writing.

It is also an object of the present invention to provide a method for preparing a printing plate with a good ink acceptance and a good printing endurance.

SUMMARY OF THE INVENTION

According to the present invention there is provided a method for preparing a lithographic printing plate, comprising the step of dispensing in a predetermined pattern a hydrophobic or hydrophobizing composition onto a receiving element comprising on a support a layer comprising hydrophobic thermoplastic polymer particles dispersed in a hardened hydrophilic binder.

DETAILED DESCRIPTION OF THE INVENTION

The advantage of using a receiving element according to the invention for ink jet printing lies in the fact that a part of the image can be made by contact with a thermal head or by irradiation with a laser (heat-mode).

The imaging element according to the present application comprises (i) on a support an image forming layer comprising hydrophobic thermoplastic polymer particles dispersed in a hardened hydrophilic binder and preferably (ii) a compound capable of converting light to heat, said compound being comprised in said image forming layer or a layer adjacent thereto.

Specific examples of hydrophobic polymer particles for use in connection with the present application have a Tg above 80° C.

Preferably the polymer particles are selected from the group consisting of polyvinyl chloride, polyvinylidene chloride, polyacrylonitrile, polyvinyl carbazole etc., copolymers or mixtures thereof. Most preferably used are polystyrene, polymethylmethacrylate or copolymers thereof.

Suitable hydrophilic binders for use in an image-forming layer in connection with this application are water soluble (co)polymers for example synthetic homo- or copolymers such as polyvinylalcohol, a poly(meth)acrylic acid, a poly (meth)acrylamide, a polyhydroxy-ethyl(meth)acrylate, a polyvinylmethylether or natural binders such as gelatin, a polysaccharide such as e.g. dextran, pullulan, cellulose, arabic gum, alginic acid, inuline or chemically modified inuline.

The image-forming layer also comprises crosslinking agents such as formaldehyde, glyoxal, polyisocyanate or a hydrolyzed tetra-alkylorthosilicate. The latter is particularly preferred.

The imaging element further preferably includes a compound capable of converting light to heat. Suitable compounds capable of converting light into heat are preferably infrared absorbing components although the wavelength of absorption is not of particular importance as long as the absorption of the compound used is in the wavelength range of the light source used for image-wise exposure. Particularly useful compounds are for example dyes and in particular infrared dyes and pigments and in particular infrared pigments such as carbon black, metal carbides, borides, nitrides, carbonitrides, bronze-structured oxides and oxides structurally related to the bronze family but lacking the A component e.g. WO 2.9.

The support according to the present application can be a hydrophilic support such as aluminum e.g. electrochemically and/or mechanically grained and anodized aluminum.

As hydrophobic support in connection with the present embodiment it is particularly preferred to use a plastic film e.g. substrated polyethylene terephthalate film, substrated polyethylene naphthalate film, cellulose acetate film, polystyrene film, polycarbonate film etc. . . The plastic film support may be opaque or transparent. Also suitable as flexible support is glass with a thickness less than 1.2 mm and a failure stress (under tensile stress) equal or higher than $5\times10^7$.

It is particularly preferred to use a polyester film support to which an adhesion-improving layer has been provided. Particularly suitable adhesion improving layers for use in accordance with the present invention comprise a hydrophilic binder and colloidal silica as disclosed in EP-A-619 524, EP-A-620 502 and EP-A-619 525. Preferably, the amount of silica in the adhesion-improving layer is between 200 mg per $m^2$ and 750 mg per $m^2$. Further, the ratio of silica to hydrophilic binder is preferably more than 1 and the surface area of the colloidal silica is preferably at least 300 $m^2$ per gram, more preferably at least 500 $m^2$ per gram.

The hydrophobic composition can be a hot melt composition. The hot melt composition used in the present invention is a solid hydrophobic composition that is melted in the ink jet printhead. A hot melt composition, also called a phase change composition consists of a hot melt ink carrier composition, and a dye. The phase change ink carrier may be a composition containing optionally a natural wax or a mixture of natural waxes or a mixture of (a) natural and (a) synthetic wax(es). The main requirement for the composition according to the invention is to be a meltable, jettable hydrophobic substance having appropriate physical characteristics, e.g. a phase change ink carrier. Thus, dyes and coloring agents are not required , but can help the operator to see the image on the plate.

A phase change ink carrier composition typically comprises a fatty amide-containing material. The fatty amide-containing material of the phase change ink carrier composition preferably comprises a tetra-amide compound. The preferred tetra-amide compounds for producing the phase change ink carrier composition are diner acid-based tetra-amides which preferably include the reaction product of a fatty acid, a diamine (ethylene diamine) and a dimer acid. Fatty acids having from 10 to 22 carbon atoms are preferably employed in the formation of the dimer acid-based tetra-amide.

The fatty amide-containing material can also comprise a mono-amide. In fact, in the preferred case, the phase change ink carrier composition comprises both a tetra-amide compound and a mono-amide compound. The mono-amide compound typically comprises either a primary or secondary mono-amide, but is preferably a secondary mono-amide.

The preferred fatty amide-containing compounds of this invention comprise a plurality of fatty amide materials that are physically compatible with each other. Typically, even when a plurality of fatty amide-containing compounds are employed to produce the phase change ink carrier composition, the carrier composition has a substantially single melting point transition. The melting point of the phase change ink carrier composition is preferably at least about 70° C., more preferably at least about 80° C., and most preferably at least about 85° C.

In a preferred case, the phase change ink carrier composition comprises a tetra-amide and a mono-amide compound, a tackifier, a plasticizer, and a viscosity-modifying agent. The preferred compositional ranges of this phase change ink carrier composition are as follows : from about 10 to 50 weight percent of a tetra-amide compound, from about 30 to 80 weight percent of a mono-amide compound, from about 0 to 25 weight percent of a tackifier, from about 0 to 25 weight percent of a plasticizer, and from about 0 to 10 weight percent of a viscosity modifying agent.

As previously indicated, the subject phase change ink formed from the phase change ink carrier composition exhibits excellent physical properties. More details are given in EP-A 353 979.

Other preferred phase change ink carriers and phase change inks are disclosed in EP-A-519 138, EP-A-604 023, EP-A-739 958, U.S. Pat. No. 5,592,204, WO-96/015201, U.S. Pat. No. 5,531,819, U.S. Pat. No. 5,560,765, WO 90/005893, WO-91/010711, WO-91/010710 and EP-A-723 999.

In still another embodiment of the present invention the composition can comprise a curable hydrophobic organic compound.

In a preferred embodiment of the present invention a curable fluid composition, more preferably an actinic light curable fluid composition, most preferably an UV-curable fluid composition is used as solidifiable organic compound. In one embodiment the curable composition to be used in the present invention usually contains as essential components a polymerizable compound having at least one ethylenically unsaturated double bond in the molecule and a polymerization initiator. In the polymerizable composition according to the present invention, linear organic polymers, volatilization preventing agents, surfactants, heat polymerization inhibitors, coupling agents, dyes, viscosity adjusting agents and other additives (e.g. plasticizers) are further added, if necessary.

The polymerizable compounds are the compounds characterized by having at least one ethylenically unsaturated double bound that is cured by radical addition polymerization initialized by a polymerization initiator activated by addition of energy such as actinic light or heat. These compounds include mono- and poly-unsaturated carboxylic acids esters such as acrylate esters of polyhydroxy compounds such as ethylene glycol, tetraethylene glycol, neopentylglycol, propylene glycol, 1,2-butanediol, trimethylolpropane, pentaerythritol and di-pentaerythritol and the like with the above-described unsaturated carboxylic acids, diglycidylester of phthalic acid and the like with the above-described unsaturated carboxylic acids. These photopolymerizable compounds are present in the photopolymerizable compositions according to the present invention in an amount of 20 to 99.9% by weight, preferably 25 to 99% by weight, more preferably 30 to 98% by weight.

The polymerization initiators are the compounds which generate radicals under the influence of added energy, preferably actinic light.

The photopolymerization initiators used in actinic light curable compositions are the compounds which generate radical species by absorbing the light from ultraviolet and visible wavelengths. These photopolymerization initiators are used in an amount of from 0.1 to 50% by weight, preferably 1 to 30% by weight, more preferably 2 to 20% by weight in the photopolymerizable compositions according to the present invention. When the content of the photopolymerization initiator is less than 0.1% by weight, the printing durability of the printing member decreases since curing of the image parts is insufficient or the curing time should be unpracticably long. Storage stability of the photopolymerizable ink compositions will be reduced when the content is above 50% by weight.

In still another embodiment of the present invention the composition can comprise latex of a hydrophobic organic particle in an aqueous medium. A latex is defined as a stable colloidal dispersion of a polymeric substance in an aqueous medium. The polymer particles are usually approximately spherical and of typical colloidal dimensions: particle diameters range from about 20 to 1000 nm. The dispersion medium is usually a dilute aqueous solution containing substances such as electrolytes, surfactants, hydrophilic polymers and initiator residues. The polymer lattices are classified in various ways. By origin, they are classified as natural lattices, produced by metabolic processes occurring in the cells of certain plant species; synthetic lattices, produced by emulsion polymerization of monomers; and artificial lattices, produced by dispersing a polymer in a dispersing medium.

A hydrophobic polymer for use in the present lattices has preferably a Tg below 150° C., more preferably a Tg below 120° C.

A hydrophobic polymer for use in the present invention has preferably a Tg of at least 30° C., more preferably a Tg of at least 35° C.

The hydrophobic polymer synthetic latex for use in the present lattices may contain conventional emulsifiers.

Hydrophobic polymers for use in synthetic lattices according to the present invention are, for example, polystyrene, polyacrylates such as polymethyl methacrylate and polybutyl acrylate, copolymers of butyl acrylate and methyl methacrylate, copolymers of butyl acrylate and styrene, homopolymers of butadiene, copolymers of butadiene and methyl methacrylate.

The hydrophobic polymer synthetic latex particles have preferably a particle size between 0.01 and 1 $\mu$m, more preferably between 0.01 $\mu$m and 0.25 $\mu$m.

The latex can contain from 1 to 60% by weight of hydrophobic polymer, more preferably from 2 to 40% by weight of hydrophobic polymer, most preferably from 5 to 20% by weight of hydrophobic polymer.

In still another embodiment of the present invention the hydrophobizing composition can comprise a transition metal complex reactive component, preferably chromium complexes of organic acids. This transition metal complex reactive component reacts with polyvinyl alcohol. Even if hardened polyvinyl alcohol is used, sufficient reactive groups are present to interact with the reactive component.

The image forming requires the following steps. On demand, microdots of the hydrophobic composition are sprayed onto the receiving element according to the invention in a predetermined pattern as the plate passes through the printer or by a printhead shuttling over the plate. According to one embodiment of the invention, the microdots have a diameter of about 30 $\mu$m.

The image forming can also be carried out with the lithographic base already on the printing cylinder.

The printing plate of the present invention can also be used in the printing process as a seamless sleeve printing plate. This cylindrical printing plate has such a diameter that it can be slided on the print cylinder. More details on sleeves are given in "Grafisch Nieuws" ed. Keesing, 15, 1995, page 4 to 6.

The following examples illustrate the present invention without limiting it thereto. All parts and percentages are by weight unless otherwise specified.

EXAMPLE 1

On a subbed polyethylene terephthalate film of 100 $\mu$m thick was coated coated an IR-sensitive layer to a wet coating thickness of 70 $\mu$m from a solution having the following composition:

- 17.28 g of a $TiO_2$ dispersion in water (average particle size 0.3 to 0.5 $\mu$m)-25.97% w/w.
- 8.44 g of hydrolyzed tetramethylorthosilicate in water-24.86% w/w.
- 1 g of wetting agent-5% w/w.
- 9.11 g of non-ionic stabilized polystyrene latex-12.8% w/w.
- 0.20 g of IR-dye A
- 33.95 of water.

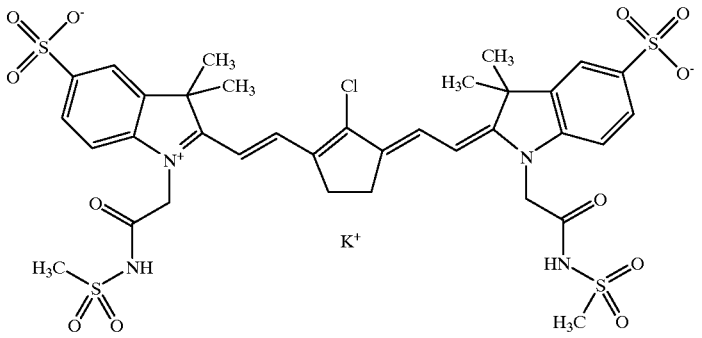

IR-Dye A

This layer was hardened for 12 hours at 67° C. and 50% R.H. An imaging element was so obtained.

On said plate was sprayed with a HP690C a solution of 14% of ALNOVOL™ (trade name of a novolac of Clariant, Germany) in isopropanol. The imaged plate was printed on a printing press AB Dick with as ink Van Son Rubberbase and as fountain 2% Tame. The ink acceptance was very good from the first copy, the density was very good from the tenth copy and the wear of the printing plate was very low.

What is claimed is:

1. A method for preparing a lithographic printing plate, comprising the step of dispensing in a predetermined pattern a hydrophobic or hydrophobizing composition onto a receiving element comprising on a support a layer comprising hydrophobic thermoplastic polymer particles dispersed in a hardened hydrophilic binder.

2. A method for preparing a lithographic printing plate according to claim 1 wherein said layer comprising hydrophobic thermoplastic polymer particles dispersed in a hydrophilic binder comprises crosslinking agents.

3. A method for preparing a lithographic printing plate according to claim 1 wherein said layer comprising hydrophobic thermoplastic polymer particles dispersed in a hydrophilic binder comprises a compound capable of converting light to heat.

4. A method for preparing a lithographic printing plate according to claim 1 wherein said hydrophobic thermoplastic polymer particle is selected from the group consisting of polystyrene, polymethylmethacrylate and copolymers thereof.

5. A method for preparing a lithographic printing plate according to claim 1 wherein said hydrophobic or hydrophobizing composition is a hot melt composition.

6. A method for preparing a lithographic printing plate according to claim 1 wherein said hydrophobic or hydrophobizing composition comprises a curable hydrophobic organic compound.

7. A method for preparing a lithographic printing plate according to claim 1 wherein said hydrophobic or hydrophobizing composition is a latex of a hydrophobic organic particle in an aqueous medium.

8. A method for preparing a lithographic printing plate according to claim 1 wherein said hydrophobic or hydrophobizing composition comprises a transition metal complex reactive component.

* * * * *